US007804471B2

(12) United States Patent
Ieong et al.

(10) Patent No.: US 7,804,471 B2
(45) Date of Patent: Sep. 28, 2010

(54) LIQUID CRYSTAL DISPLAY AND DRIVING METHOD AND DRIVING CIRCUIT THEREOF

(75) Inventors: Man-Fai Ieong, Miao-Li (TW); Sz-Hsiao Chen, Miao-Li (TW); Eddy Giing-Lii Chen, Miao-Li (TW)

(73) Assignees: Innocom Technology (ShenZhen) Co., Ltd., Shenzhen, Guangdong Province (CN); Chimel Innolux Corporation, Miao-Li County (TW)

( * ) Notice: Subject to any disclaimer, the term of this patent is extended or adjusted under 35 U.S.C. 154(b) by 802 days.

(21) Appl. No.: 11/784,995

(22) Filed: Apr. 9, 2007

(65) Prior Publication Data

US 2007/0236436 A1 Oct. 11, 2007

(30) Foreign Application Priority Data

Apr. 7, 2006 (TW) ..... 95112486 A

(51) Int. Cl.
*G09G 3/36* (2006.01)

(52) U.S. Cl. ..... 345/87; 345/98; 345/100

(58) Field of Classification Search ..... 345/87, 345/98, 100

See application file for complete search history.

(56) References Cited

U.S. PATENT DOCUMENTS

| | | | | |
|---|---|---|---|---|
| 6,307,681 | B1 | 10/2001 | Aoki et al. | |
| 7,199,777 | B2 | 4/2007 | Moon | |
| 7,215,311 | B2 * | 5/2007 | Kim | 345/100 |
| 2002/0041267 | A1 * | 4/2002 | Jung | 345/92 |
| 2003/0214470 | A1 * | 11/2003 | Sun | 345/87 |
| 2005/0001800 | A1 | 1/2005 | Ha | |
| 2005/0168491 | A1 * | 8/2005 | Takahara et al. | 345/690 |
| 2006/0290644 | A1 * | 12/2006 | Kim | 345/100 |

FOREIGN PATENT DOCUMENTS

CN 1504984 A 6/2004

* cited by examiner

*Primary Examiner*—Richard Hjerpe
*Assistant Examiner*—Jeffrey S Steinberg
(74) *Attorney, Agent, or Firm*—Wei Te Chung

(57) ABSTRACT

An exemplary driving circuit (250) of an LCD (200) includes: gate lines (210) that are parallel to each other and that each extend along a first direction; data lines (202) that are parallel to each other and that each extend along a second direction substantially orthogonal to the first direction; a gate driving circuit (210) connected to the gate lines; a data driving circuit (220) connected to the data lines; and a pre-charging voltage circuit (240). The pre-charging voltage circuit is configured to provide a pre-charging voltage to each of the data lines before the gate driving circuit scans the gate lines.

8 Claims, 6 Drawing Sheets

| $m_1, m_2$ | $s_1$ | $s_2$ |
|---|---|---|
| 0,0 | $V_1^+$ | $V_2^-$ |
| 0,1 | $V_2^-$ | $V_2^-$ |
| 1,0 | $V_1^+$ | $V_1^+$ |
| 1,1 | $V_2^-$ | $V_1^+$ |

| | $V_{d1}$ | $V_{d2}$ | $V_{d3}$ | $V_{d4}$ | | $V_{dm-1}$ | $V_{dm}$ |
|---|---|---|---|---|---|---|---|
| 1 | + | − | + | − | | + | − |
| 2 | + | − | + | − | | + | − |
| | | | | | | | |
| n−1 | + | − | + | − | | + | − |
| n | + | − | + | − | | + | − |

FIG. 4

| | $V_{d1}$ | $V_{d2}$ | $V_{d3}$ | $V_{d4}$ | | $V_{dm-1}$ | $V_{dm}$ |
|---|---|---|---|---|---|---|---|
| 1 | − | + | − | + | | − | + |
| 2 | − | + | − | + | | − | + |
| | | | | | | | |
| n−1 | − | + | − | + | | − | + |
| n | − | + | − | + | | − | + |

FIG. 5

LIQUID CRYSTAL DISPLAY AND DRIVING METHOD AND DRIVING CIRCUIT THEREOF

FIELD OF THE INVENTION

The present invention relates a driving circuit, a liquid crystal display (LCD) having using the driving circuit, and a method for driving the LCD.

GENERAL BACKGROUND

An LCD has the advantages of portability, low power consumption, and low radiation, and has been widely used in various portable information products such as notebooks, personal digital assistants (PDAs), video cameras and the like. Furthermore, the LCD is considered by many to have the potential to completely replace CRT (cathode ray tube) monitors and televisions.

FIG. 7 is essentially an abbreviated circuit diagram of a driving circuit of a typical LCD. The driving circuit 100 includes a number n (where n is a natural number) of gate lines 101 that are parallel to each other and that each extend along a first direction, a number m (where m is also a natural number) of data lines 102 that are parallel to each other and that each extend along a second direction orthogonal to the first direction, a plurality of thin film transistors (TFTs) 106 that function as switching elements, a plurality of pixel electrodes 103, a plurality of common electrodes 105, a gate driving circuit 110, and a data driving circuit 120. The crossed gate lines 101 and data lines 102 define an array of pixel units of the LCD. Each pixel unit includes a respective TFT 106, a respective pixel electrode 103, and a respective common electrode 105. The TFT 106 is provided in the vicinity of a respective point of intersection of the gate lines 101 and the data lines 102. The gate driving circuit 110 is used to drive the gate lines 101. The data driving circuit 120 is used to drive the data lines 102.

FIG. 8 is an equivalent circuit diagram relating to the driving circuit 100 at any one of the pixel units. A gate electrode 1062, a source electrode 1064, and a drain electrode 1066 of the TFT 106 are connected to a corresponding gate line 101, a corresponding data line 102, and a corresponding pixel electrode 103 respectively. Liquid crystal material sandwiched between the pixel electrode 103 on a first substrate (not shown) and the common electrode 105 on a second substrate (not shown) is represented as a liquid crystal capacitor $C_{lc}$. $C_{sd}$ is a parasitic capacitor formed between the source electrode 1064 and the drain electrode 1066 of the TFT 106.

The data line 102 has an essential resistance R, which associated with the parasitic capacitor $C_{sd}$ forms an RC (resistance-capacitance) delay circuit. The RC delay circuit distorts a data signal applied to the data line 102. A distortion of the data signal is determined by the essential resistance R and a capacitance of the parasitic capacitor $C_{sd}$.

Referring also to FIG. 9, this is a waveform diagram showing distortion of a data signal applied to any one of the data lines 102. $V_{d1}$ shows a waveform of the data signal when the data signal is adjacent the data driving circuit 120. $V_{d2}$ shows a waveform of the data signal when the data signal is far from the data driving circuit 120. The distortion of the data signal becomes more pronounced with increasing distance from the data driving circuit 120. If the LCD is large, the data line 102 is correspondingly long. Therefore the problem of data signal distortion may be significant, and the display performance of the LCD is liable to be impaired.

What is needed, therefore, is an LCD that can overcome the above-described deficiencies.

SUMMARY

In one preferred embodiment, a driving circuit of an LCD includes: a plurality of gate lines that are parallel to each other and that each extend along a first direction; a plurality of data lines that are parallel to each other and that each extend along a second direction substantially orthogonal to the first direction; a gate driving circuit connected to the gate lines; a data driving circuit connected to the data lines; and a pre-charging voltage circuit. The pre-charging voltage circuit is configured to provide a pre-charging voltage to each of the data lines before the gate driving circuit scans the gate lines.

Other novel features and advantages will become more apparent from the following detailed description when taken in conjunction with the accompanying drawings.

BRIEF DESCRIPTION OF THE DRAWINGS

FIG. 4 is a diagram showing a polarity distribution of data signals applied to the data lines of the LCD of FIG. 1 during odd-numbered frames.

FIG. 5 is a diagram view showing a polarity distribution of data signals applied to the data lines of the LCD of FIG. 1 during even-numbered frames.

DETAILED DESCRIPTION OF PREFERRED EMBODIMENTS

Figure 1:
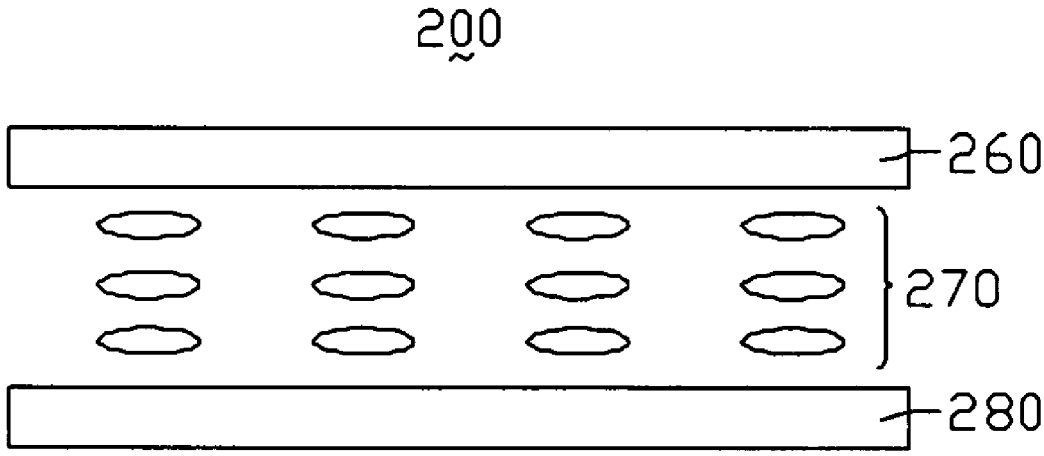
FIG. 1 is side, cross-sectional view of an LCD according to an exemplary embodiment of the present invention, the LCD including a driving circuit (not shown).

Referring to FIG. 1, an LCD 200 according to an exemplary embodiment of the present invention is shown. The LCD 200 includes a first substrate 260, a second substrate 280 opposite to the first substrate 260, a liquid crystal layer 270 sandwiched between the first and second substrates 260, 280, and a driving circuit (not shown).

Figures 2, 3:
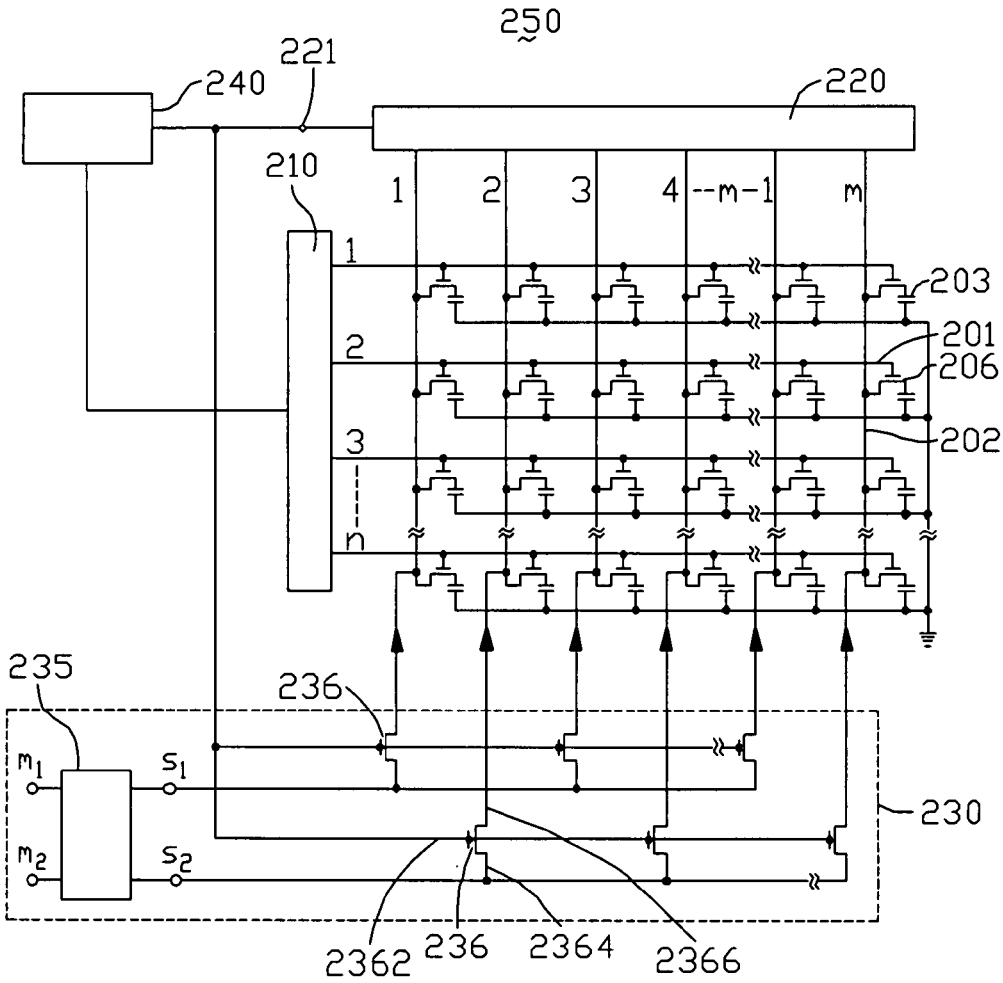
FIG. 2 is essentially an abbreviated circuit diagram of the driving circuit of the LCD of FIG. 1, the driving circuit including 'n' parallel gate lines, 'm' parallel data lines, and a pre-charging voltage circuit having two input terminals and two output terminals.
FIG. 3 is a correspondence table in relation to the pre-charging voltage circuit of FIG. 2, showing a relationship between binary signals input at the two input terminals and pre-charging voltages output at the two output terminals of the pre-charging voltage circuit.

Referring also to FIG. 2, the driving circuit 250 includes a number n (where n is a natural number) of gate lines 201 that are parallel to each other and that each extend along a first direction, a number m (where m is also a natural number) of data lines 202 that are parallel to each other and that each extend along a second direction orthogonal to the first direction, a plurality of first thin film transistors (TFTs) 206 that function as switching elements, a plurality of pixel electrodes 203, a gate driving circuit 210, a data driving circuit 220, a pre-charging voltage circuit 230, and a clock controller 240. Each first TFT 206 is provided in the vicinity of a respective point of intersection of the gate lines 201 and the data lines 202. A gate electrode, a source electrode, and a drain electrode of each first TFT 206 are connected to a corresponding gate line 201, a corresponding data line 202, and a corresponding pixel electrode 203 respectively.

The gate driving circuit 210 is used to drive the gate lines 201. The data driving circuit 220 includes an enabling terminal 221. When a low voltage is applied to the enabling terminal 221, the data driving circuit 210 provides data signals to the data lines 202. When a high voltage is applied to the enabling terminal 221, the data driving circuit 220 does not provide data signals to the data lines 202.

The clock controller 240 is respectively connected with the gate driving circuit 210, the enabling terminal 221 of the data driving circuit 220, and the pre-charging voltage circuit 230, in order to control displaying of images by the LCD 200.

The pre-charging voltage circuit 230 includes a pre-charging voltage generator 235 and a plurality of second TFTs 236. The pre-charging voltage generator 235 includes a first input terminal $m_1$, a second input terminal $m_2$, a first output terminal $s_1$, and a second output terminal $s_2$. Each second TFT 236 includes a gate electrode 2362 connected to the clock controller 240, a source electrode 2364 connected to either the first output terminal $s_1$ or the second output terminal $s_2$, and a drain electrode 2366 connected to a corresponding one of the data lines 202. The first output terminal $s_1$ is connected to odd-column data lines 202 at points thereof farthest from the data driving circuit 220, via corresponding of the second TFTs 236. The second output terminal $s_2$ is connected to even-column data lines 202 at points thereof farthest from the data driving circuit 220, via corresponding of the second TFTs 236. When the clock controller 240 provides a high voltage to the gate electrodes 2362 of the second TFTs 236, the second TFTs 236 are switched on so that the pre-charging voltage circuit 230 provides a plurality of pre-charging voltages to the data lines 202 at the points thereof farthest from the data driving circuit 220, via the second TFTs 236.

Referring to FIG. 3, this is a correspondence table in relation to the pre-charging voltage circuit 230, showing a relationship between binary signals input at the two input terminals $m_1$, $m_2$ and pre-charging voltages output by the two output terminals $s_1$, $s_2$ of the pre-charging voltage circuit 230. When two binary signals 0, 0 are respectively input at the two input terminals $m_1$, $m_2$, the two output terminals $s_1$, $s_2$ output a positive pre-charging voltage $V_1^+$ and a negative pre-charging voltage $V_2^-$ respectively. When two binary signals 0, 1 are respectively input at the two input terminals $m_1$, $m_2$, the two output terminals $s_1$, $s_2$ each output a negative pre-charging voltage $V_2^-$. When two binary signals 1, 0 are respectively input at the two input terminals $m_1$, $m_2$, the two output terminals $s_1$, $s_2$ each output a positive pre-charging voltage $V_1^+$. When two binary signals 1, 1 are respectively input at the two input terminals $m_1$, $m_2$, the two output terminals $s_1$, $s_2$ output a negative pre-charging voltage $V_2^-$ and a positive pre-charging voltage $V_1^+$ respectively.

Generally, inverse methods of driving an LCD include: a dot inverse method, a column inverse method, a row inverse method, and a plane inverse method. The different inverse methods need different pre-charging voltages. In the following description, for convenience, an inverse method of the LCD 200 is assumed to be a column inverse method.

FIG. 4 shows a polarity distribution of data signals applied to the data lines 202 of the LCD 200 during odd-numbered frames. FIG. 5 shows a polarity distribution of data signals applied to the data lines 202 of the LCD 200 during even-numbered frames. $V_{d1}$-$V_{dm}$ represent polarities of data signals applied to the respective data lines 202.

During odd-numbered frames, because the data signals applied to the odd-column data lines 202 are positive voltages, and the data signals applied to the even-column data lines 202 are negative voltages, a pre-charging voltage applied to the odd-column data lines 202 is a positive voltage $V_1^+$, and a pre-charging voltage applied to the even-column data lines 202 is a negative voltage $V_2^-$. That is, the output terminals $s_1$, $s_2$ respectively output the positive pre-charging voltage $V_1^+$ and the negative pre-charging voltage $V_2^-$.

During even-numbered frames, a pre-charging voltage applied to the odd-column data lines 202 is a negative voltage $V_2^-$, and a pre-charging voltage applied to the even-column data lines 202 is a positive voltage $V_1^+$. That is, the output terminals $s_1$, $s_2$ respectively output the negative pre-charging voltage $V_2^-$ and the positive pre-charging voltage $V_1^+$.

Figure 6:
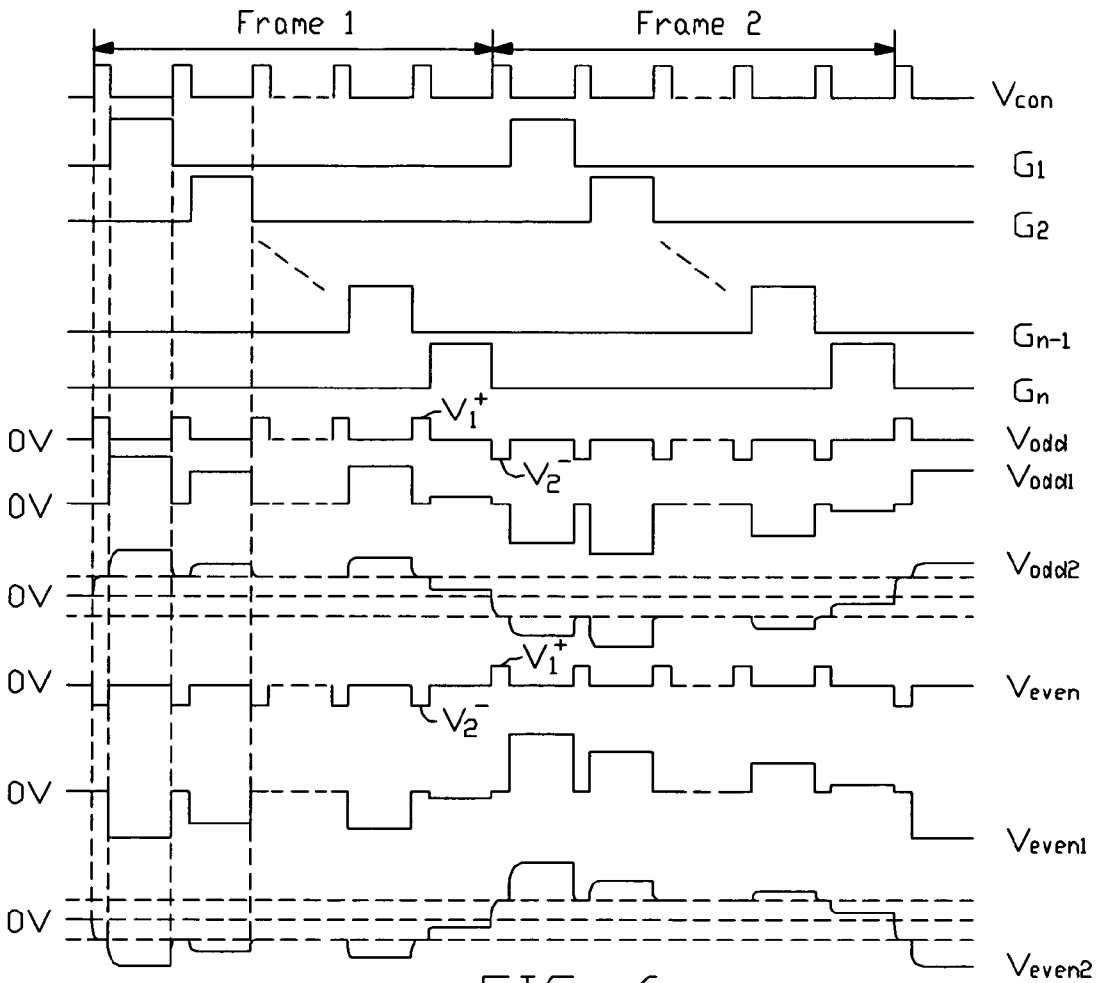
FIG. 6 is a waveform diagram of driving signals of the LCD of FIG. 1.
Figure 7:
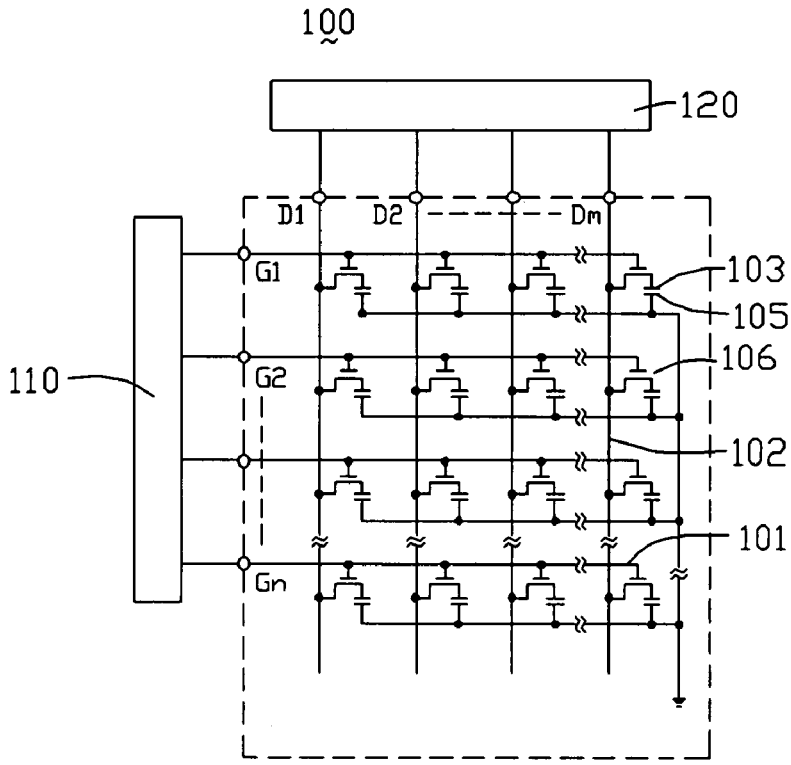
FIG. 7 (RELATED ART)
FIG. 7 is essentially an abbreviated circuit diagram of a driving circuit of a conventional LCD, the driving circuit including a plurality of gate lines, a plurality of data lines, and a plurality of pixel units.
Figure 8:
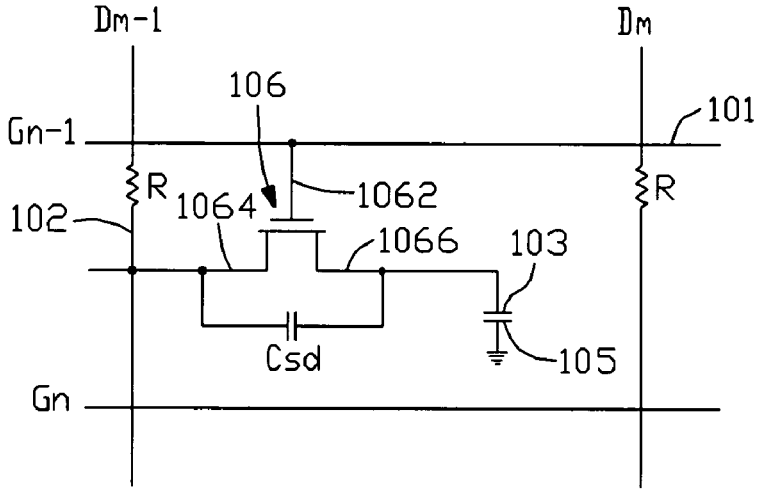
FIG. 8 (RELATED ART)
FIG. 8 is an equivalent circuit diagram relating to the driving circuit at any one of the pixel units of the LCD of FIG. 7.
Figure 9:
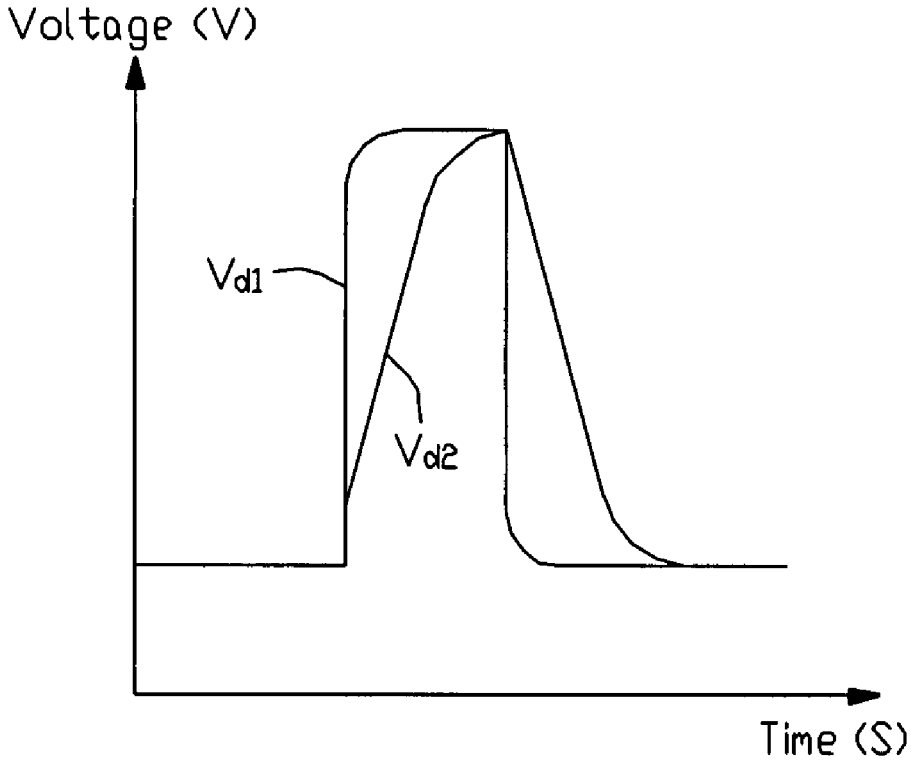
FIG. 9 (RELATED ART)
FIG. 9 is a waveform diagram showing distortion of a data signal applied to any one of the data lines of the driving circuit of FIG. 7.

Referring to FIG. 6, this is a waveform diagram of driving signals of the LCD 200. $V_{con}$ represents a voltage waveform of the enabling terminal 221 of the data driving circuit 220. $G_1$-$G_n$ represent waveforms of scanning signals. $V_{odd}$ represents a pre-charging voltage waveform applied to the odd-column data lines 202. $V_{even}$ represents a pre-charging voltage waveform applied to the even-column data lines 202. $V_{odd1}$ represents a waveform of data signals applied to the odd-column data lines 202. $V_{even1}$ represents a waveform of data signals applied to the even-column data lines 202. $V_{odd2}$ represents a voltage waveform at points of the odd-column data lines 202 farthest from the data driving circuit 220. $V_{even2}$ represents a voltage waveform at points of the even-column data lines 202 farthest from the data driving circuit 220. The exemplary column inverse method of driving the LCD 200 includes the following steps.

During odd-numbered frames, before the gate driving circuit 210 scans the gate lines 201, the clock controller 240 provides a high voltage to the enabling terminal 221 of the data driving circuit 220 and the gate electrodes 2362 of the second TFTs 236. Thus the second TFTs 236 are switched on, so that the pre-charging voltage circuit 230 provides a positive voltage $V_1^+$ to the points of the odd-column data lines 220 farthest from the data driving circuit 220, and provides a negative voltage $V_2^-$ to the points of the even-column data lines 220 farthest from the data driving circuit 220. When the gate driving circuit 210 scans the gate lines 201, the clock controller 240 provides a low voltage to the enabling terminal 221 of the data driving circuit 220 and the gate electrodes 2362 of the second TFTs 236. Thus the second TFTs 236 are switched off, so that the pre-charging voltage circuit 230 provides a negative voltage $V_2^-$ to the points of the odd-column data lines 220 farthest from the data driving circuit 220, and provides a positive voltage $V_1^+$ to the points of the even-column data lines 220 farthest from the data driving circuit 220.

During even-numbered frames, before the gate driving circuit 210 scans the gate lines 201, the clock controller 240 provides a high voltage to the enabling terminal 221 of the data driving circuit 220 and the gate electrodes 2362 of the second TFTs 236. Thus the second TFTs 236 are switched on, so that the pre-charging voltage circuit 230 provides a negative voltage $V_2^-$ to the points of the odd-column data lines 220 farthest from the data driving circuit 220, and provides a positive voltage $V_1^+$ to the points of the even-column data lines 220 farthest from the data driving circuit 220. When the gate driving circuit 210 scans the gate lines 201, the clock controller 240 provides a low voltage to the enabling terminal 221 of the data driving circuit 220 and the gate electrodes 2362 of the second TFTs 236. Thus the second TFTs 236 are switched off, so that the pre-charging voltage circuit 230 provides a positive voltage $V_1^+$ to the points of the odd-column data lines 220 farthest from the data driving circuit 220, and provides a negative voltage $V_2^-$ to the points of the even-column data lines 220 farthest from the data driving circuit 220.

In summary, because the pre-charging voltage circuit 240 provides a pre-charging voltage to each of the points of the data lines 202 farthest from the data driving circuit 220 via the second TFTs 236 before the gate driving circuit 210 scans the gate lines 201, distortion of the data signals due to portions of the data lines 202 farthest from the data driving circuit 220 jumping from zero to a level of the data signals applied thereto is significantly lessened and may even be eliminated. Thus, a display performance of the LCD 200 is improved.

Further or alternative embodiments may include the following. In one example, the inverse method of driving the LCD 200 can be a row inverse method or a plane inverse method. In such cases, the first output terminal $s_1$ is connected to the data lines 202 via the source electrodes 2364 of the second TFTs 236, and the second output terminal $s_2$ is floating. Further, the gate electrode 2362 of each second TFT 236 is connected to the clock controller 240.

It is to be understood, however, that even though numerous characteristics and advantages of the present embodiments have been set out in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A driving circuit of a liquid crystal display (LCD), the driving circuit comprising:

a plurality of gate lines that are parallel to each other and that each extend along a first direction;

a plurality of data lines that are parallel to each other and that each extend along a second direction substantially orthogonal to the first direction;

a gate driving circuit connected to the gate lines;

a data driving circuit connected to the data lines;

a pre-charging voltage circuit comprising a pre-charging voltage generator and a plurality of thin film transistors, the pre-charging voltage circuit configured to provide a pre-charging voltage to each of the data lines before the gate driving circuit scans the gate lines; and a clock controller connected to the gate driving circuit, the driving circuit, and the pre-charging voltage circuit respectively;

wherein the data lines are arranged in columns, the pre-charging voltage generator comprises a first input terminal, a second input terminal, a first output terminal connected to odd-column data lines, and a second output terminal connected to even-column data lines, and each thin film transistor comprises a gate electrode connected to the clock controller.

2. The driving circuit as claimed in claim 1, wherein the first output terminal is connected to points of the odd-column data lines farthest from the data driving circuit via a corresponding plurality of the thin film transistors, and the second output terminal is connected to points of the even-column data lines farthest from the data driving circuit via a corresponding plurality of the thin film transistors.

3. A liquid crystal display (LCD), comprising:

a first substrate;

a second substrate opposite to the first substrate;

a liquid crystal layer sandwiched between the first and second substrates;

a gate driving circuit connected to a plurality of gate lines;

a data driving circuit connected to a plurality of data lines;

a pre-charging voltage circuit comprising a pre-charging voltage generator and a plurality of thin film transistors, the pre-charging voltage circuit configured to provide a pre-charging voltage to each of the data lines before the gate driving circuit scans the gate lines; and a clock controller connected to the gate driving circuit, the data driving circuit, and the pre-charging voltage circuit respectively;

wherein the pre-charging voltage generator comprises a first input terminal, a second input terminal, a first output terminal, and a second output terminal that is floating, and each thin film transistor comprises a gate electrode connected to the clock controller, a source electrode connected to the first output terminal, and a drain electrode connected to a corresponding data line.

4. The LCD as claimed in claim 3, wherein the first output terminal is connected to points of the data lines farthest from the data driving circuit via the thin film transistors, respectively.

5. A driving method for a liquid crystal display (LCD), the LCD comprising a plurality of gate lines, a plurality of data lines arranged in columns, a gate driving circuit, a data driving circuit , and a pre-charging voltage circuit, the method comprising:

the pre-charging voltage circuit providing a pre-charging voltage to the data lines before the gate driving circuit scans the gate lines, comprising during odd-numbered frames, the pre-charging voltage circuit providing a positive pre-charging voltage to points of odd-column data lines farthest from the data driving circuit, and providing a negative pre-charging voltage to points of even-column data lines farthest from the data driving circuit; and the data driving circuit driving the data lines when the gate driving circuit scans the gate lines.

6. The driving method as claimed in claim 5, wherein the data driving circuit driving the data lines comprises, during the odd-numbered frames, the data driving circuit providing a positive voltage to the odd-column data lines, and providing a negative voltage to the even-column data lines.

7. The driving method as claimed in claim 5, wherein the pre-charging voltage circuit providing a pre-charging voltage to the data lines further comprises, during even-numbered frames, the pre-charging voltage circuit providing a negative pre-charging voltage to points of odd-column data lines farthest from the data driving circuit, and providing a positive pre-charging voltage to points of even-column data lines farthest from the data driving circuit.

8. The driving method as claimed in claim 7, wherein the data driving circuit driving the data lines comprises, during the even-numbered frames, the data driving circuit providing a negative voltage to the odd-column data lines, and providing a positive voltage to the even-column data lines.

* * * * *